United States Patent [19]

Rhoades

[11] 4,230,381

[45] Oct. 28, 1980

[54] TWO PIECE CABINET COVER

[75] Inventor: John P. Rhoades, San Antonio, Tex.

[73] Assignee: Stainless Icetainer Company, San Antonio, Tex.

[21] Appl. No.: 58,970

[22] Filed: Jul. 20, 1979

[51] Int. Cl.[3] ..... E05D 15/58; B65D 43/00

[52] U.S. Cl. ..... 312/295; 312/299; 312/304; 220/331; 220/345; 16/179

[58] Field of Search ..... 312/294, 295, 299, 304, 312/100; 49/397; 16/172, 177, 179; 220/331, 340, 345

[56] References Cited

U.S. PATENT DOCUMENTS

| | | | |
|---|---|---|---|
| 1,134,540 | 4/1915 | Kress | 312/295 |
| 1,173,558 | 2/1916 | Cosmen et al. | 220/331 |
| 1,193,347 | 8/1916 | Bauer | 312/295 |
| 2,014,591 | 9/1935 | Sanders | 220/331 |
| 2,202,476 | 5/1940 | Baker | 312/295 |
| 2,202,684 | 5/1940 | Baker | 312/295 |
| 2,223,023 | 11/1940 | Weilemann | 220/345 |
| 2,416,132 | 2/1947 | Watson | 312/304 |
| 2,644,192 | 7/1953 | McClellan | 16/179 |
| 2,752,628 | 7/1956 | Platson | 16/179 |
| 3,208,809 | 9/1965 | Quimper | 312/295 |

*Primary Examiner*—Victor N. Sakran
*Attorney, Agent, or Firm*—Henry C. Kovar

[57] ABSTRACT

A two-piece cover for covering and enabling access to an open topped cabinet box, has a retaining lid and a captured lid which are interconnectable in either of a pivotal or sliding configuration; either of the lids may be separately opened and both are self-closing when pivotally connected, and either of the lids is slidably openable when the lids are slidably connected; a new retainer clip is provided for interconnecting the lids and for serving as at least part of a stop structure for limiting pivotal or sliding opening. A pin is alternatively provided in place of the retainer clip; the cover is sanitary and especially well suited for the storage bins of ice machines.

19 Claims, 9 Drawing Figures

TWO PIECE CABINET COVER

BACKGROUND OF THE INVENTION

1. Field of the Invention

This invention pertains to a hinge on and for openable top covers of a cabinet.

2. Prior Art

The top covers previously utilized on top access cabinets such as ice cream freezers and ice cube bins, have been split enabling access from either side of the cabinet. The top covers typically rest upon the top of the cabinet and are not fastened to the cabinet.

One type of door is split down the middle with a hinge; either of the doors can be lifted and pivotally opened upwardly upon the other door. These center hinged pivotal doors have not been slidably openable.

A second type of door has been a split slider door. The doors have been split down the centerline and one door will slide under the other door and the other door will slide over the one door. These slider doors have not been pivotally openable.

Both the hinged and slider doors have been objected to by health approval agencies as being relatively unsanitary and very difficult to clean and/or sanitize. These agencies are now requiring that hinged doors be self-closing so that people serving ice or food from the cabinets cannot leave the door open.

OBJECTS OF THE INVENTION

It is an object of the present invention to provide a split cabinet door which is either pivotally or slidably openable.

It is an object of the present invention to provide a two-sided cabinet door in which either side is pivotally openable with both sides being self-closing.

It is an object of the present invention to provide a two-sided cabinet door in which both of the sides are either pivotally or slidably openable and in which the sides are separable from each other for cleaning and sanitizing.

It is an object of the present invention to provide a new retainer structure which retains one cover to a second cover to be pivotally opened with respect to the one cover, or to be slidably opened with respect to the second cover.

SUMMARY OF THE INVENTION

In accordance with the principles of the present invention, a two-piece cover for closing an upward facing opening in a cabinet box has a cover retaining lid with a top panel having side flanges depending from the top panel and a retainer flange extending from an edge of the top panel and a stop edge on the bottom of the retainer flange, an internal captured lid retainer is mounted to the retainer lid and has first, second and third stop surfaces, and a cover captured lid has a cover panel having an upright edge flange extending generally perpendicular to the cover panel and an arm extending generally perpendicular from the upright flange and away from the cover panel with the lids being interconnectable in either of a limited pivotal connection such that the captured lid is self-closing or in a sliding connection in which the captured lid is slidable underneath the retainer lid.

ON THE DRAWINGS

AS SHOWN ON THE DRAWINGS

Figure 1:
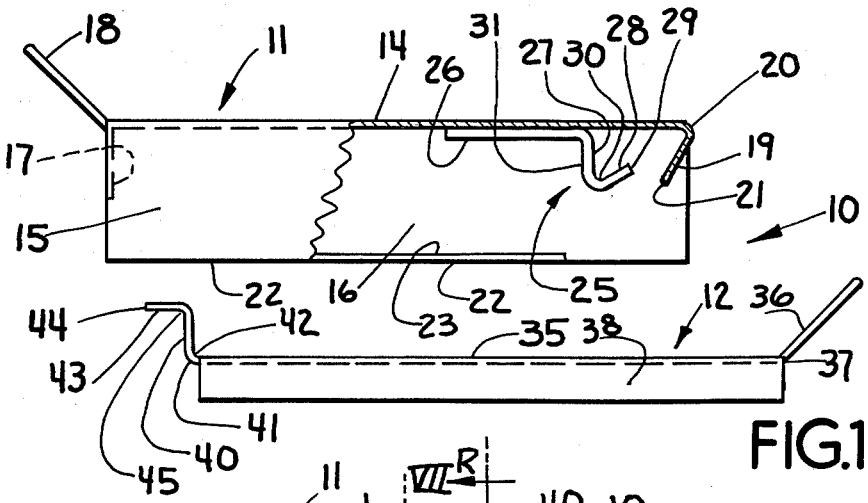
FIG. 1 is an end elevational view, in partial section, of the preferred structural embodiment of the cover of the present invention with the retaining lid and captured lid being shown discretely.

The present invention is particularly useful when embodied in a two piece openable cover, generally indicated by the numeral 10 in FIG. 1 and which is inclusive of a retaining lid 11, and a captured lid 12. The lids 11, 12 are intended to be joined together and mounted on top of a cabinet box 13 having an upward facing opening 50 needed to be covered.

The retaining lid 11 has a top panel 14, side flanges 15, 16 depending downwardly from the top panel 14, an outer flange 17, a handle 18, and a downward extending retainer flange 19 along and depending from the top panel edge 20. The retainer flange 19 is formed down from top panel 14 and edge 20 at least ninety degrees, and preferably the flange 19 is turned under the top and forms an included angle of about sixty degrees between itself and the top panel 14. The outer ends of the retainer flange 19 may be welded to the side panels 15, 16 for rigidity and at the bottom of the retainer flange 19 there is a stop edge 21. Each of the side flanges 15, 16 has a bottom edge 22 which supports the retaining lid 11 on and above the cabinet 13, and the retainer flange stop edge 21 is substantially nearer to the top panel 14 than the bottom edges 22. The lid 11 may be made of sheet metal such as stainless steel.

Figure 7:
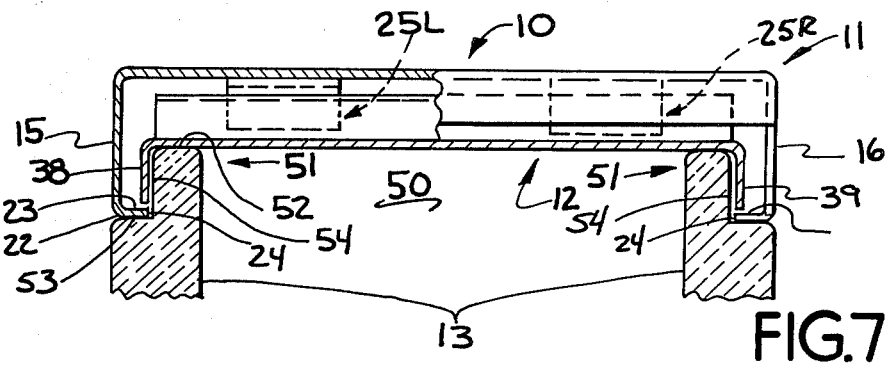
FIG. 7 is a front elevational sectional view taken through lines VII L—VII L; and lines VII R—VII R in FIG. 2.

An internal retainer clip, generally indicated by the numeral 25, is mounted to the underside of the top panel 14 in a position adjacent and laterally parallel to, but spaced inwardly from the retainer flange 19 and its stop edge 21. The clip 25 has a body 26 welded or fastened directly to the top panel 14, a leg 27 which extends downward from the top panel 14, a foot 28 extending from the leg 27 and generally toward the retainer flange 19, and a toe 29 on the distal end of the foot 28. The toe 29 is spaced inwardly of the retainer flange 19 and its stop edge 21. The stop edge 21 is positioned at a level which is further below and spaced further from the top panel 14 than is the clip toe 29. The foot 28 extends upwardly at an angle of about thirty degrees above horizontal and directly toward the top panel edge 20 from which the retainer flange 19 depends. In between the leg 27 and foot 28 there is a clip root 30 which is spaced a predetermined distance from the retainer flange stop edge 21. It is preferable that the retainer clip 25 be segmented as is shown in FIG. 7 wherein there is a discrete left clip 25L adjacent side flange 15, and a discrete right clip 25R adjacent side flange 16. The retainer flange 19 and the clip foot 28 form between themselves a projected included angle of less than ninety degrees with the illustrated angle being about thirty degrees; this angle is measured from the edge 20. The rear surface 31 of the leg 25 forms a stop surface as do the toe 29 and root 30 as will be described.

The captured lid 12 has a cover panel 35, a handle 36 adjacent to a first edge 37 of the cover panel 35, and a pair of side flanges 38, 39. An upright flange 40 extends generally perpendicular to the cover panel 35 from a second edge 41 which is relatively opposite to edge 37. The second edge 41 has a prominent external radius, and at the intersection between the cover panel 35 and flange 40 there is a root 42. An arm 43 extends generally perpendicular from the upright flange 40 and away from the cover panel 35. The arm 43 has on its distal end a stop edge 44. The arm 43 is of a greater length than the retainer clip foot 28, and the clip toe 29 is spaced from the retainer flange stop edge 21 a distance which is less than the length of the arm 43. The arm 43 and upright flange 40 are sized so that the distance from the stop edge 44 to the root 42 is substantially the same as the distance between the retaining cover stop edge 21 and the clip root 30. The clip 25 is positioned so that the toe 29 is closer to the top panel 14 than the retainer flange stop edge 21, and is thus concealed. While the retainer clip 25 is preferably segmented, the radius 41, upright flange 40, root 42, arm 43 and stop edge 44 extend continuously across the width of the captured lid 12 and its cover panel 35. The clip 25 has essentially three stop surfaces. The first is the root 30 which faces upward towards the underside of the top panel 14; the second is the leg 27 which faces toward the retainer flange 19; and the third is the rear surface 31 which is inward of and faces opposite to the leg 27.

As best shown in FIG. 7, the lids 11, 12 are both supported on the cabinet box 13 and close the upward facing opening 50 through and bounded by a peripheral rim 51. The rim 51, on each side of the cabinet box 13, has a top surface 52 upon which the captured lid cover panel 35 supportingly rests, an upward facing way 53 which is outside of and below the top surface 52, and a lateral facing thrust surface 54. The lower edge 22 of each retainer cover side flange 15, 16 rests upon a respective way 53 for support of the retainer lid 11; more specifically, the lower edge 22 is preferably the lower surface of a bottom flange 23. The thrust surface 54 laterally locates the captured lid 12 by being closely fitted within the flanges 38, 39 and also laterally locates the retainer lid 11 by being closely fitted to inside edges 24 of the bottom flanges 23.

Figure 2:
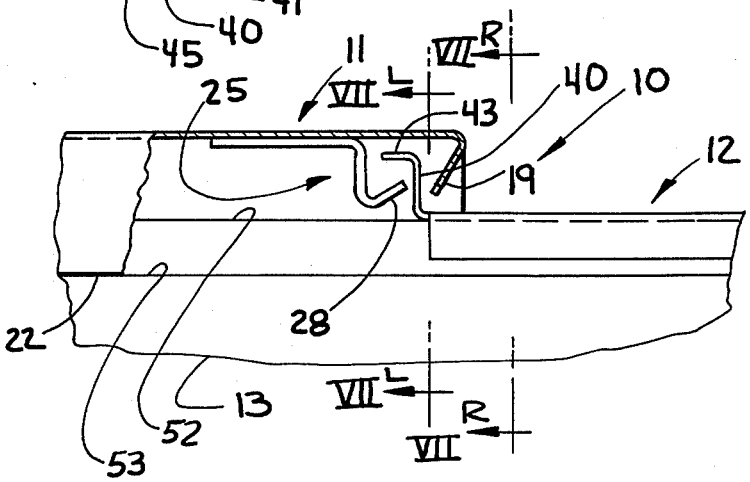
FIG. 2 is an end elevational view, in partial section, of the structure of FIG. 1 pivotally joined together and upon a cabinet.

Use and operation of the cover 10 are best illustrated in FIGS. 2–6. In FIG. 2, the cover 10 rests upon the cabinet 13 and the retaining lid 11 and captured lid 12 are joined together in a pivotal connection by virtue of the upright flange 40 and arm 43 being captive within and between the retainer flange 19 and clip 25. When the lids 11, 12 are pivotally joined as shown, they will not separate because the arm 43 cannot fall out in the space between the stop edge 21 and toe 29.

Figure 3:
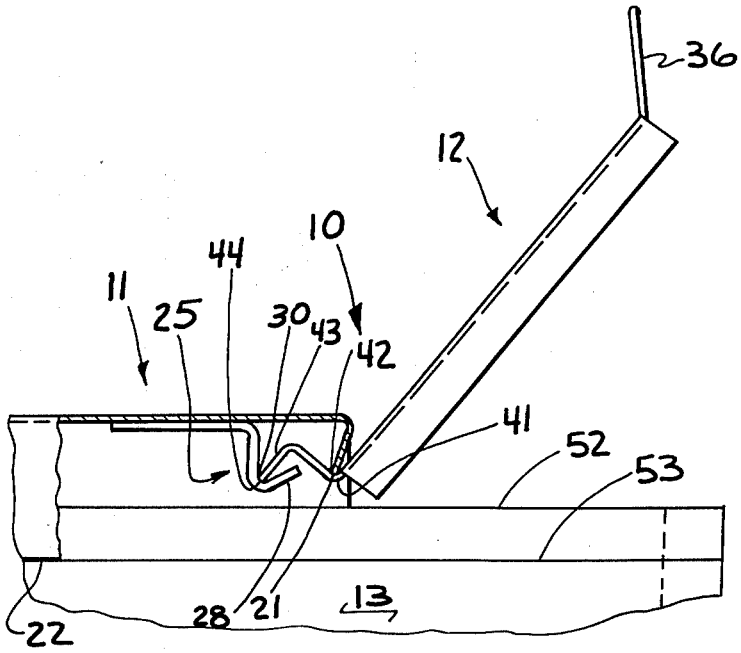
FIG. 3 is an end elevational view, in partial section, of the structure of FIG. 2 with the captured lid in an opened position.

FIG. 3 illustrates the captured lid 12 in a pivotally opened position. The captured lid 12 has been pivotally opened by the handle 36 with respect to the retaining lid 11 until pivotal opening has been stopped at about fifty degrees above horizontal and in a self-closing position by abutting engagement of stop edge 44 against root 30, and by root 42 against stop edge 21. The lids 11, 12 will not disconnect as the arm 43 overlaps the foot 28. The radius 41 rolls on the cabinet top surface 52 as the lid 12 is pivotally opened or closed.

Figure 4:
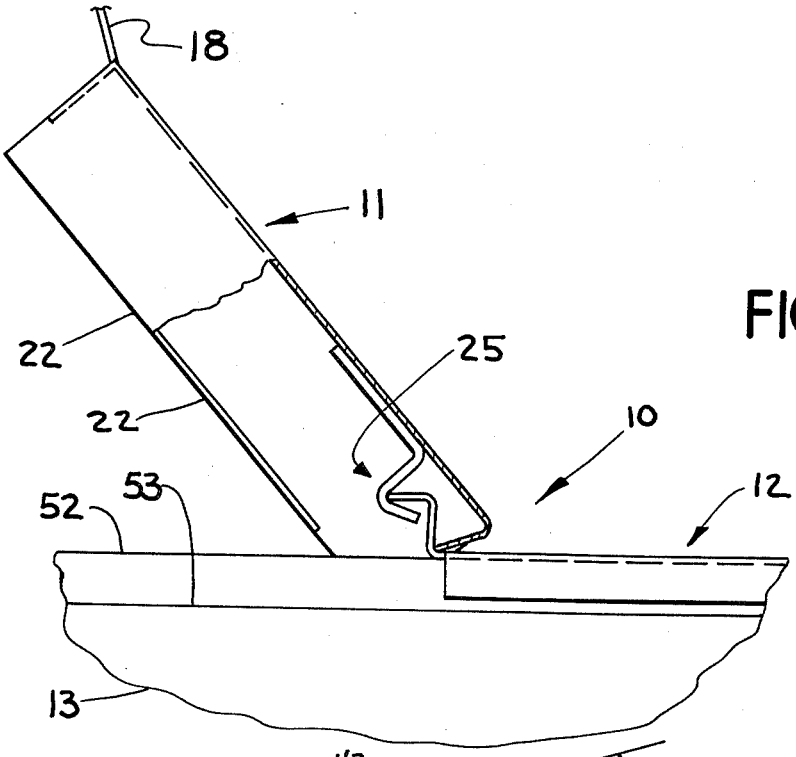
FIG. 4 is an end elevational view, in partial section, of the structure of FIG. 2 with the retaining lid in an opened position.

FIG. 4 illustrates the retaining lid 11 in a pivotally opened position. The retaining lid 11 is opened by lifting the handle 18 and pivotally opening the lid 11 until the stop edges 21, 44 abuttingly engage the roots 42, 30 respectively just as in FIG. 3, and the angular opening of the retaining lid 11 is limited to the same angle as the captured lid 12, i.e. about fifty degrees, and the retaining lid 11 is also self-closing. The lids 11, 12 each are pivotally openable, self-closing, and provide an approximately equal access from either side into the cabinet 13. Any liquid or particulate contaminate falling on either of the lids 11, 12 will end up in the root 42 and eventually fall to the outside of top surface 52 and will not fall into the cabinet opening 50.

Figure 5:
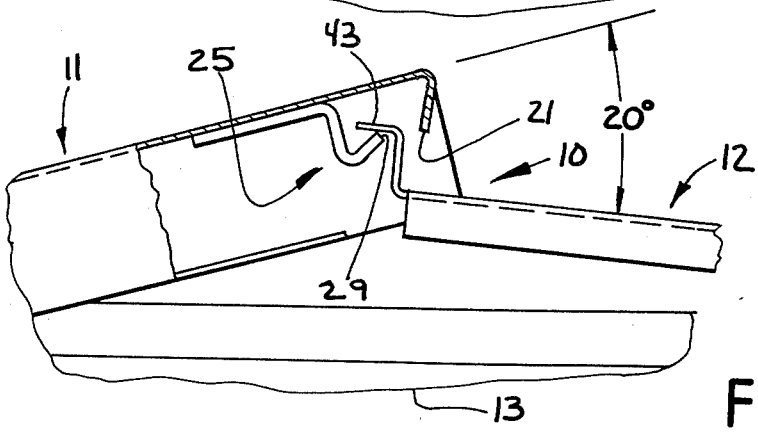
FIG. 5 is an end elevational view, in partial section, of the structure of FIG. 1 illustrating a position for connection or disconnection of the retaining and captured lids.

FIG. 5 illustrates the cover 10 in a position where it has been centrally raised until an angle of about twenty degrees is formed between the lids 11, 12. In this position, the arm 43 will slide either inward or outward of the stop edge 21 and toe 29 for pivotal connection or disconnection as desired.

Figure 6:
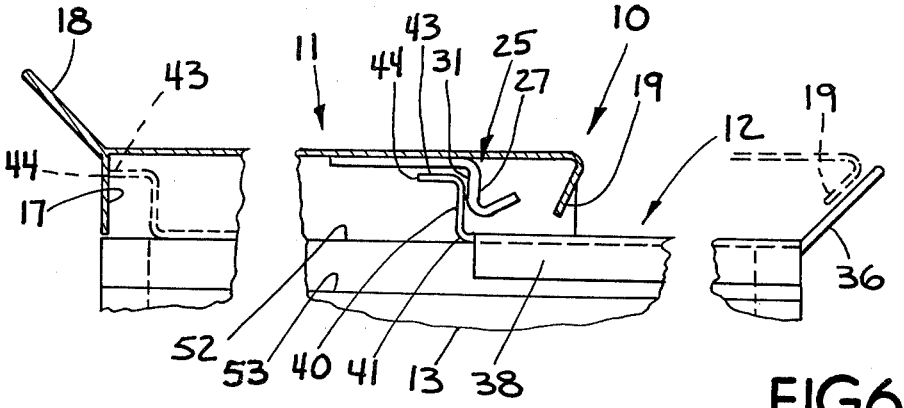
FIG. 6 is an end elevational view, in partial section, of the structure of FIG. 1 slidingly joined together and upon a cabinet.

FIG. 6 illustrates the cover 10 in a sliding interconnection wherein either of the lids 11, 12 can be slid into an open position. The retaining lid 11 rests in the same position as if the lid 11 were in FIGS. 2 or 3. The captured lid 12, however, is in a different position, and is positioned more centrally on the cabinet 13 than as in FIGS. 2, 3 or 4. The captured lid 12 has its upright flange 40 and arm 43 behind or inward of the leg 27 of the retainer clip 25. The upright flange 40 abuts against the leg rear surface 31 for slidingly stopping the captured lid 12 in its outer position and also for slidingly stopping the retaining lid 11 in its outer position; the lids 11, 12 slidingly stop each other with respect to themselves. When the captured lid 12 is opened, it is slid under the retaining lid 11 and inward on the top surface 52 until the stop edge 44 abuts against the inside of the retaining lid outer flange 17 as shown in dotted line in the left of FIG. 6. When the retaining lid 11 is opened, it is slid over the captured lid 12 until the stop edge 44 abuts the inside of the outer flange 17 as just described; the retainer flange 19 slides up over the lid 12 as shown in the right side of FIG. 6.

The cover 10 may be made either pivotal or sliding at the discretion of the owner, and can be changed from pivotal to sliding or vice-versa at the discretion of the owner.

Figure 8:
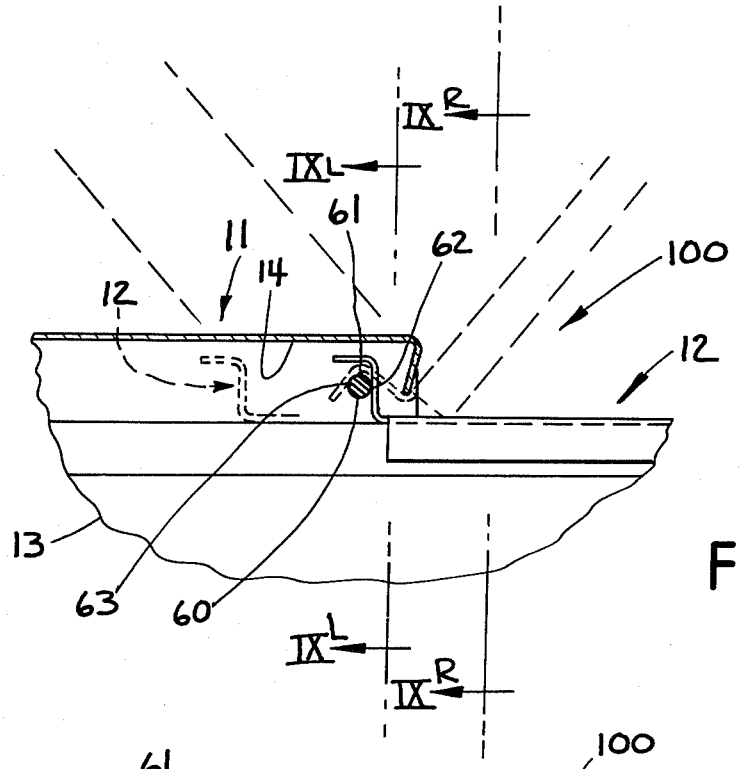
FIG. 8 is an end elevational view, in partial section, of an alternative structural embodiment of the present invention.
Figure 9:
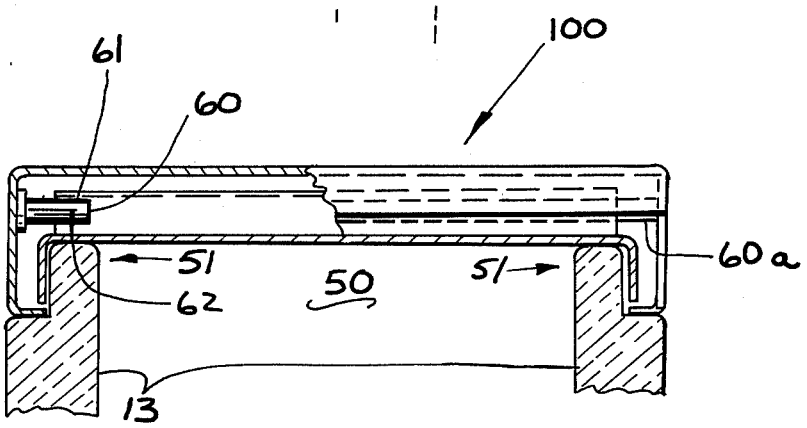
FIG. 9 is a front elevational sectional view taken through lines IX L—IX L and IX R—IX R of FIG. 8.

An alternative construction is shown in FIGS. 8 and 9 wherein a round pin 60 is utilized rather than the retainer clip 25. Some sanitation officials prefer the pin 60 to the retainer clip 25 as the pin does not have the retainer clip root 30 which is physically difficult to get at. The pin 60 physically and functionally replaces the retainer clip 25 and a top surface 61 of the pin 60 forms a first stop surface facing upwards towards and spaced downwardly from the underside of the top panel 14, a front surface 62 forms a second stop surface facing toward and spaced inwardly of the retainer flange 19 and its stop edge 21, and a rear surface 63 forms a third stop surface inward of and facing opposite to the front surface 62. All of the top, front and rear stop surfaces 61, 62, 63 are nearer to the top panel 14 than is the retainer flange stop edge 21. Both of the top and front stop surfaces 61, 62 are spaced closer to the retainer flange stop edge 21 than the length of the captured cover arm 43. The pin 60 may be segmented as shown on the left side of FIG. 9, or may be continuous across the lid 11 as alternatively shown on the right side of FIG. 9 and identified by 60*a*.

The cover 100 having the pin 60 functions the same as does the cover 10 with the retainer clip. The captured lid 12 is absolutely identical and the retaining lid 11 is identical save for the substitution of the pin 60 for the clip 25.

The lids 11, 12 can be interconnected in either pivotal or sliding connection. Either of the lids opens pivotally about fifty degrees and is self-closing. When the lids 11, 12 with the pin 60 are pivotally stopped, the pin 60 abuts against a top root 45 of the captured lid 12. The lids 11, 12 with the pin 60 are also interconnectable in sliding relationship wherein the lid 12 is shown in dotted line in FIG. 8 underneath the lid 11.

The cover 10 offers many advantages, some of which have been previously described. The lids 11, 12 can be removed, separated and washed and sanitized in a dishwasher. The lids 11, 12 are sanitary, self-closing, can be either pivotal or slidingly openable, the retainer lid 11 can be semi-permanently fastened to the cabinet 13 leaving the captured lid 12 either pivotally or slidably openable.

Although various minor modifications may be suggested by those versed in the art, it should be understood that I wish to embody within the scope of the patent warranted hereon all such embodiments as reasonably come within the scope of my contribution to the art.

I claim as my Invention:

1. A two-piece openable cover for normally closing an upward facing opening in a cabinet box, comprising (a) a retaining lid having a top panel, side flanges depending from the top panel, a downward extending retaining flange along and depending from one of the edges of the top panel, and a stop edge on the bottom of the retainer flange;

(b) an internal retainer clip mounted to the underside of said top panel in a position adjacent and parallel to but spaced just inwardly from said retainer flange, said clip having a leg extending downward from the top panel, a foot extending from the leg and generally toward the retainer flange, and a toe on the distal end of the foot, said toe being spaced inwardly of the retainer flange; and (c) a captured lid having a cover panel, a handle adjacent to a first edge of the cover panel, an upright flange extending generally perpendicular to the cover panel from a second and relatively opposite edge thereon, and an arm extending generally perpendicular from the upright flange and away from the cover panel; and in which (d) said lids are positively interconnectable in either of (1) a limited pivotal connection in which the captured lid upright flange and arm are captured within and between the retainer lid retainer flange and retainer clip, said upright flange and arm being abuttable against the retainer flange and clip respectively for providing only limited pivotal movement of the captured lid with respect to the retainer lid, so that said captured lid is self-closing when so-pivotally connected, and (2) a sliding connection in which the captured lid upright flange and arm are captured inwardly of the retainer clip and under the top panel, said lids being relatively slidable with respect to each other with the captured lid going underneath the retainer flange and the clip into a position underneath the retainer lid.

2. A cover according to claim 1, in which said retainer flange is turned under the top panel and extends inwardly underneath the top panel, said stop edge being inwardly of the top panel edge from which said retainer flange depends.

3. A cover according to either of claims 1 or 2, in which the retainer flange stop edge is nearer the top panel than bottom edges of the retaining lid side flanges.

4. A cover according to claim 1, in which the retainer clip foot extends directly toward the top panel edge from which the retainer flange depends.

5. A cover according to either of claims 1, 2 or 4, in which the retainer clip toe is spaced from retainer flange a distance less than the length of the captured lid arm.

6. A cover according to claim 5, in which the retainer flange stop edge is further from the top panel than the retainer clip toe.

7. A cover according to claim 1, in which a first root between the retainer clip leg and foot is spaced a predetermined distance from the retainer flange stop edge, and in which a stop edge on the captured lid arm is spaced a substantially like predetermined distance from a second root between the captured lid cover panel and the upright flange, said first root being abuttable against the arm stop edge while the retainer flange stop edge is abutted against the second root, for limiting pivotal opening of the lids with respect to each other.

8. A cover according to either of claims 1, 2, 4, or 7, in which the upright flange and arm extend continuously across the captured lid cover panel, in which the retainer flange and stop edge extend continuously across the retainer lid, and in which the retainer clip is segmented with there being a discrete such clip adjacent each side flange on the retainer lid.

9. A cover according to claim 1, in which the captured lid arm is of a greater length than the retainer clip foot.

10. A cover according to either of claims 2 or 4, in which the retainer flange and the foot form between themselves a projected included angle of less than ninety degrees.

11. A two-piece openable cover for normally closing an upward facing opening in a cabinet box, comprising (a) a retaining lid having a top panel, side flanges depending from the top panel, a downward extending retainer flange along and depending from one of the edges of the top panel, and a stop edge on the bottom of the retainer flange, (b) an internal captured lid retainer mounted to the retainer lid adjacent and parallel to the retainer flange, said retainer having (1) a first stop surface facing upwards toward and spaced downwardly from the underside of the top panel, (2) a second stop surface facing towards and spaced inwardly from the retainer flange, and (3) a third stop surface inward of and facing opposite to the second stop surface;

(c) a captured lid having a cover panel, a handle adjacent to a first edge of the cover panel, an upright flange extending generally perpendicular to the cover panel from a second and relatively opposite edge thereon, and an arm extending generally perpendicular from the upright flange and away from the cover panel; and in which:

(d) said lids are positively interconnectable and fittable upon said cabinet box in either of (1) a limited pivotal connection in which the captured lid upright flange and arm are captured within and between the retainer lid retainer flange and the retainer, said upright flange and arm being abuttable against the retainer flange and retainer for providing only limited pivotal movement of the captured lid with respect to the retainer lid, so that said captured lid is self-closing when so-pivotally connected, and (2) a sliding connection in which the captured lid upright flange and arm are captured inwardly of the retainer and under the top panel, said lids being relatively slidable with respect to each other with the captured lid going underneath the retainer flange and the retainer into an alternate and opened position underneath the retainer lid, when so slidably interconnected.

12. A cover according to claim 11, in which said stop surfaces are positioned nearer to the top panel than is the retainer flange stop edge.

13. A cover according to either of claims 11 or 12, in which the retainer flange is turned under the top panel toward the stop surfaces.

14. A cover according to either of claims 11 or 12, in which the first and second stop surfaces of the retainer are spaced from the retainer flange a distance less than the length of the captured lid arm.

15. A two-piece openable cabinet cover normally closing an upward facing opening through and bounded by a peripheral rim on a cabinet box, said cover comprising:

(a) a retaining lid on the peripheral rim, said lid having a top panel, side flanges depending from the top panel and engaging the rim for support of the lid, a downward extending retainer flange along and depending from one of the edges of the top panel, and a stop edge on the bottom of the retainer flange;

(b) an internal captured lid retainer mounted to the retainer lid adjacent and parallel to the retainer flange, said retainer having (1) a first stop surface facing upwards toward and spaced downwardly from the underside of the top panel, (2) a second stop surface facing towards and spaced inwardly from the retainer flange, and (3) a third stop surface inward of and facing opposite to the second stop surface;

(c) a captured lid also on the rim and having a cover panel over at least part of the opening, a handle adjacent to a first and outer edge of the cover panel, an upright flange extending generally perpendicular to the cover panel from a second and relatively opposite inner edge thereon, and an arm extending generally perpendicular from the upright flange and away from the cover panel; and in which (d) said lids are positively interconnectable in either of (1) a limited pivotal connection in which the captured lid upright flange and arm are captured within and between the retainer lid retainer flange, the retainer, said upright flange and arm being abuttable against the retainer flange and the retainer respectively for providing only limited pivotal movement of the captured lid with respect to the retainer lid, so that said captured lid is self-closing when so-pivotally connected, and (2) a sliding connection in which the captured lid upright flange and arm are captured inwardly of the retainer and under the top panel, said lids being relatively slidable with respect to each other with the captured lid going underneath the retainer flange and the retainer into a position underneath the retainer lid.

16. A cabinet cover according to claim 15, in which the retainer lid is supported by side flange lower edges engaging the rim, in which the captured lid is supported by the underside of the cover panel resting upon the rim, and in which the captured lid has a convex radius section between the cover panel underside and the upright flange, said radius section being rollingly engagable with the rim during initial pivotal opening of the captured lid.

17. A cabinet cover according to claim 15, in which the retainer lid loosely sits upon the rim and in which the top panel also covers at least part of the opening into the cabinet, there being a handle adjacent an outer edge of the retainer lid enabling pivotal raising of retainer lid up off of the rim while pivotally interconnected to the captive lid, said pivotal movement of the retainer lid being limited to an amount equal to the pivotal movement of the captive lid by the retainer flange stop edge, lid retainer, and upright flange and arm of the captive lid, for providing self-closing of the so-opened retainer lid.

18. A cabinet cover according to either of claims 15, 16 or 17, in which the cabinet rim includes an upward facing way in slidable supporting engagement with the retainer lid side flanges, said retainer and said retainer flange stop edge being positioned at an elevational level higher than the level of the captured lid cover panel, said retainer lid being slidable atop of the captured lid when said lids are slidingly interconnected and while the captured lid remains stationary with respect to the cabinet.

19. A two-piece openable cabinet cover normally closing an upward facing opening through and bounded by a peripheral rim on a cabinet box, comprising:

(a) a retaining lid on the peripheral rim and having a top panel, side flanges depending from the top panel, a downward extending retainer flange along and depending from one of the edges of the top panel, and a stop edge on the bottom of the retainer flange, (b) an internal retainer clip mounted to the underside of said top panel in a position adjacent and parallel to but spaced just inwardly from said retainer flange, said clip having a leg extending downward from the top panel, a foot extending from the leg and generally toward the retainer flange, and a toe on the distal end of the foot, said toe being spaced inwardly of the retainer flange, and (c) a captured lid also on the peripheral rim and having a cover panel, a handle adjacent to a first and outer edge of the cover panel, an upright flange extending generally perpendicular to the cover panel from a second relatively opposite and inner edge thereon, and an arm extending generally perpendicular from the upright flange and away from the cover panel, and in which (d) said lids are positively interconnectable and fittable upon said cabinet box rim in either of (1) a limited pivotal connection in which the captured lid upright flange and arm are captured within and between the retainer lid retaining flange and retainer clip, said upright flange and arm being abuttable against the retainer flange and clip respectively for providing only limited pivotal movement of the captured lid with respect to the retainer lid, so that said captured lid is self-closing when so-pivotally connected, and (2) a sliding connection in which the captured lid upright flange and arm are captured inwardly of the retainer clip and under the top panel, said lids being relatively slidable with respect to each other with the captured lid being slidable on the peripheral rim and underneath the retainer flange and clip into a position underneath the retainer lid and between the retainer lid and the peripheral rim, when so slidably connected.

* * * * *